US009752776B2

(12) United States Patent
Saunders

(10) Patent No.: US 9,752,776 B2
(45) Date of Patent: Sep. 5, 2017

(54) PRESSURE VESSEL AND METHOD THEREFOR

(75) Inventor: Timothy Saunders, Canoga Park, CA (US)

(73) Assignee: Gas Technology Institute, Des Plaines, IL (US)

( * ) Notice: Subject to any disclaimer, the term of this patent is extended or adjusted under 35 U.S.C. 154(b) by 1081 days.

(21) Appl. No.: 12/872,286

(22) Filed: Aug. 31, 2010

(65) Prior Publication Data

US 2012/0048408 A1 Mar. 1, 2012

(51) Int. Cl.

| | |
|---|---|
| ***B01D 47/00*** | (2006.01) |
| ***B65D 53/00*** | (2006.01) |
| ***F16J 15/02*** | (2006.01) |
| ***F23K 3/00*** | (2006.01) |

(52) U.S. Cl.

CPC ..... *F23K 3/00* (2013.01); *F23K 2203/006* (2013.01); *Y10T 137/86035* (2015.04)

(58) Field of Classification Search

USPC ..... 198/623.3, 626.4, 626.5, 626.6; 239/533.13, 533.14, 451, 452; 137/565.17

See application file for complete search history.

(56) References Cited

U.S. PATENT DOCUMENTS

| | | | |
|---|---|---|---|
| 1,011,589 | A | 12/1911 | Curtis |
| 3,245,517 | A | 4/1966 | Ward |
| 3,844,398 | A | 10/1974 | Pinat |
| 3,856,658 | A | 12/1974 | Wolk et al. |
| 3,950,147 | A | 4/1976 | Funk et al. |
| 4,043,471 | A | 8/1977 | Trumbull et al. |
| 4,044,904 | A | 8/1977 | Trumbull et al. |
| 4,069,911 | A | 1/1978 | Ray |
| 4,159,886 | A | 7/1979 | Sage |
| 4,191,500 | A | 3/1980 | Oberg et al. |
| 4,197,092 | A | 4/1980 | Bretz |
| 4,206,610 | A | 6/1980 | Santhanam |
| 4,206,713 | A | 6/1980 | Ryason |
| 4,218,222 | A | 8/1980 | Nolan, Jr. et al. |
| 4,356,078 | A | 10/1982 | Heavin et al. |
| 4,376,608 | A | 3/1983 | Meyer et al. |
| 4,611,646 | A | 9/1986 | Wassmer et al. |
| 4,988,239 | A | 1/1991 | Firth |
| 5,094,340 | A | 3/1992 | Avakov |
| 5,435,433 | A | 7/1995 | Jordan et al. |
| 5,492,216 | A | 2/1996 | McCoy et al. |
| 6,257,567 | B1 | 7/2001 | Hansmann et al. |
| 6,296,110 | B1 | 10/2001 | van Zijderveld et al. |
| 6,533,104 | B1 | 3/2003 | Starlinger-Huemer et al. |
| 6,875,697 | B2 | 4/2005 | Trivedi |
| 7,303,597 | B2 | 12/2007 | Sprouse et al. |
| 7,387,197 | B2 | 6/2008 | Sprouse et al. |
| 7,402,188 | B2 | 7/2008 | Sprouse |

(Continued)

FOREIGN PATENT DOCUMENTS

WO WO 2009009189 A2 * 1/2009 ..... B65G 53/46

*Primary Examiner* — Craig Schneider
*Assistant Examiner* — Kevin Barss
(74) *Attorney, Agent, or Firm* — Pauley Erickson & Kottis

(57) ABSTRACT

A pressure vessel includes a pump having a passage that extends between an inlet and an outlet. A duct at the pump outlet includes at least one dimension that is adjustable to facilitate forming a dynamic seal that limits backflow of gas through the passage.

19 Claims, 3 Drawing Sheets

(56) References Cited

U.S. PATENT DOCUMENTS

| | | | |
|---|---|---|---|
| 7,547,423 | B2 | 6/2009 | Sprouse et al. |
| 7,615,198 | B2 | 11/2009 | Sprouse et al. |
| 2008/0041245 | A1 | 2/2008 | Judocus |
| 2009/0025292 | A1 | 1/2009 | Calderon et al. |

* cited by examiner

PRESSURE VESSEL AND METHOD THEREFOR

STATEMENT REGARDING FEDERALLY SPONSORED RESEARCH

This invention was made with Government support under DE-FC26-04NT42237 awarded by the Department of Energy. The Government has certain rights in this invention.

BACKGROUND

This disclosure relates to pressure vessels, such as pumps for moving materials from a low pressure environment to a high pressure environment.

Gasification involves the conversion of coal or other carbon-containing solids into synthesis gas. While both dry coal and water slurry are used in the gasification process, dry coal pumping may be more efficient than current water slurry technology. Extrusion pumps move particulate dry coal material from a low pressure environment or source to a high pressure environment in preparation for the gasification process.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION OF THE PREFERRED EMBODIMENT

Figure 1:
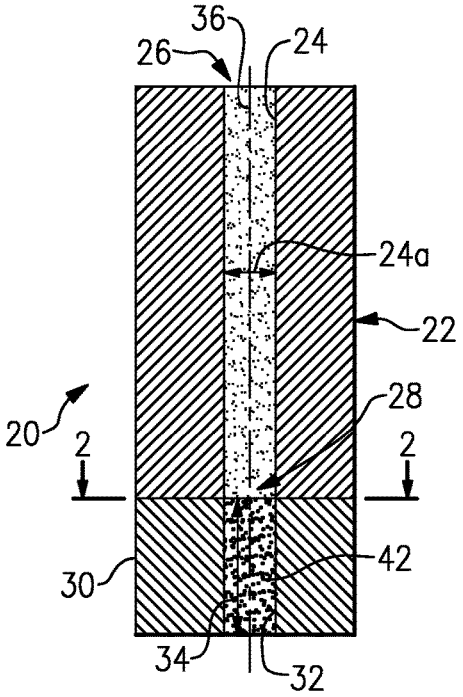
FIG. 1 illustrates an example pressure vessel having a pump and a duct at the outlet of the pump.

FIG. 1 illustrates selected portions of an example pressure vessel 20 for moving a dry particulate material, such as pulverized dry coal. Although the pressure vessel 20 is discussed with regard to moving pulverized dry coal, the pressure vessel 20 may be used to transport other kinds of particulate materials and may be used in various industries, such as petrochemical, electrical power, food, and agricultural.

The pressure vessel 20 generally includes a pump 22, shown schematically, that defines a passage 24 that extends between an inlet 26 and an outlet 28. The passage 24 includes a cross-sectional area as represented by dimension 24*a* that is generally constant between the inlet 26 and the outlet 28 of the pump 22. The pressure vessel 20 further includes a duct 30 that is located at the outlet 28 of the pump 22. In this case, the duct 30 defines a passage 32, which forms a continuation of the passage 24 from the pump 22 and has a cross-sectional area as represented by dimension 32*a* that may be substantially equal to the cross-sectional area 24*a* of the passage 24 within +/−10%.

Figure 2:
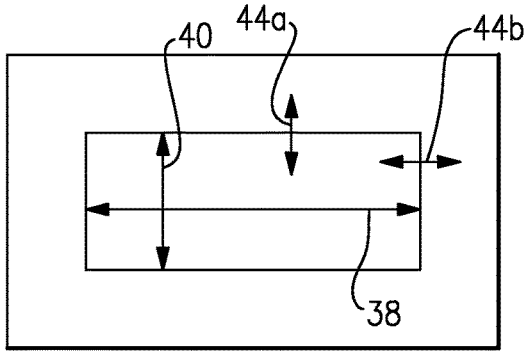
FIG. 2 illustrates a cross-section of the duct shown in FIG. 1.

Referring also to FIG. 2, the passage 32 of the duct 30 includes a length 34 that is substantially parallel to a centerline 36 of the passage 24 of the pump 22, a width 38 that is substantially perpendicular to the centerline 36, and a depth 40 that is substantially perpendicular to the centerline 36 and the width 38 (collectively, dimensions 34, 38, and 40). In some examples, at least one of the dimensions 34, 38, or 40 is adjustable to thereby change the geometry of the passage 32 through the duct 30. The dimension 34, 38, or 40 may be adjustable by up to 100%, however, in many examples an adjustability of approximately +/−10% may be sufficient. In other examples, the walls of the duct 30 may be static or fixed such that the dimensions 34, 38, and 40 are not adjustable.

In operation, the pump 22 mechanically moves a particulate material, such as dry particulate coal, through the passage 24 from the inlet 26 toward the outlet 28. As an example, the pump 22 may be a moving-wall pump, a piston pump, a screw pump, or other type of mechanical pump capable of moving particulate material. Further, the inlet 26 may be at a first fluid pressure and the outlet 28 may be at a second fluid pressure that is greater than the first fluid pressure such that the pump 22 moves the particulate material from a low pressure area to a higher pressure area. The pump 22 moves the particulate material into the passage 32 of the duct 30. The walls of the duct 30 constrict lateral movement of the particulate material with regard to the centerline 36 and thereby consolidate the material into a plug 42 of consolidated particulate material. In that regard, the plug 42 is comprised only of the particulate material and any accidental impurities. The plug 42 is densely packed to function as a seal that limits backflow of gas through the passages 32 and 24, although a limited amount of gas may leak through open interstices between the packed particles. In this regard, the plug 42 is a "dynamic seal" that is in continuous motion as the particulate material that enters the passage 32 of the duct 30 compacts and replenishes consolidated particulate material of the plug 42 that discharges from the passage 42 of the duct 30. The duct 30 and passage 32 thereby facilitate formation of the seal to reduce or eliminate the need for other seal mechanisms within the pressure vessel 20. The term "dynamic seal" may also refer to the capability of adjusting at least one dimension of the duct 30 to control the sealing within the pressure vessel 20.

Figure 3A:
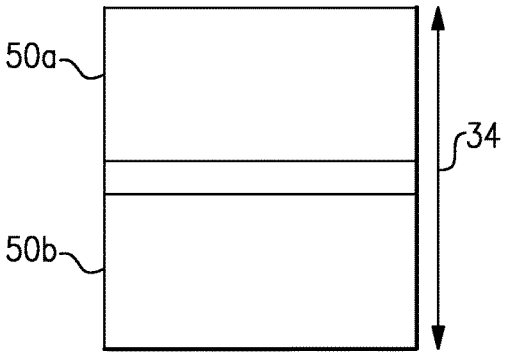
FIG. 3A illustrates an example of a wall of the duct in an extended position.
Figure 3B:
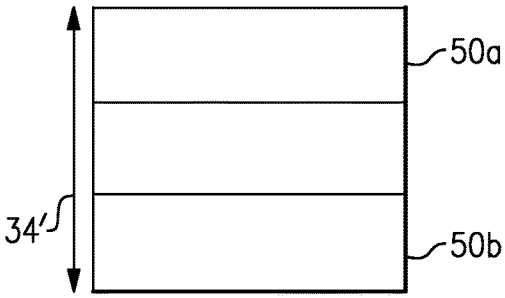
FIG. 3B illustrates the wall of the duct in a retracted position.

Optionally, the walls of the duct 30 that define the passage 32 are selectively adjustable with regard to the dimensions 34, 38, or 40, to facilitate control over the seal. As illustrated in FIG. 3A, the walls of the duct 30 may include a first wall section 50*a* and a second wall section 50*b* that is adjacent to and/or overlaps the first wall section 50*a*. An actuator or other mechanism moves the second wall section 50*b* relative to the first wall section 50*a* to adjust the length 34 to be length 34', as shown in FIG. 3B.

Alternatively, or in addition to the ability to change the length 34, the actuator is operative to move one or more of the sidewalls of the duct 30, as indicated in FIG. 2 by arrows 44*a* and 44*b* , to selectively change the width 38 or depth 40 of the passage 32. As described above, the dimensions 34, 38, and 40 may be adjusted by up to 100%, but up to 50% or even 10% may be suitable for controlling the sealing, depending on the type of pump and characteristics of the particulate material.

Figure 4:
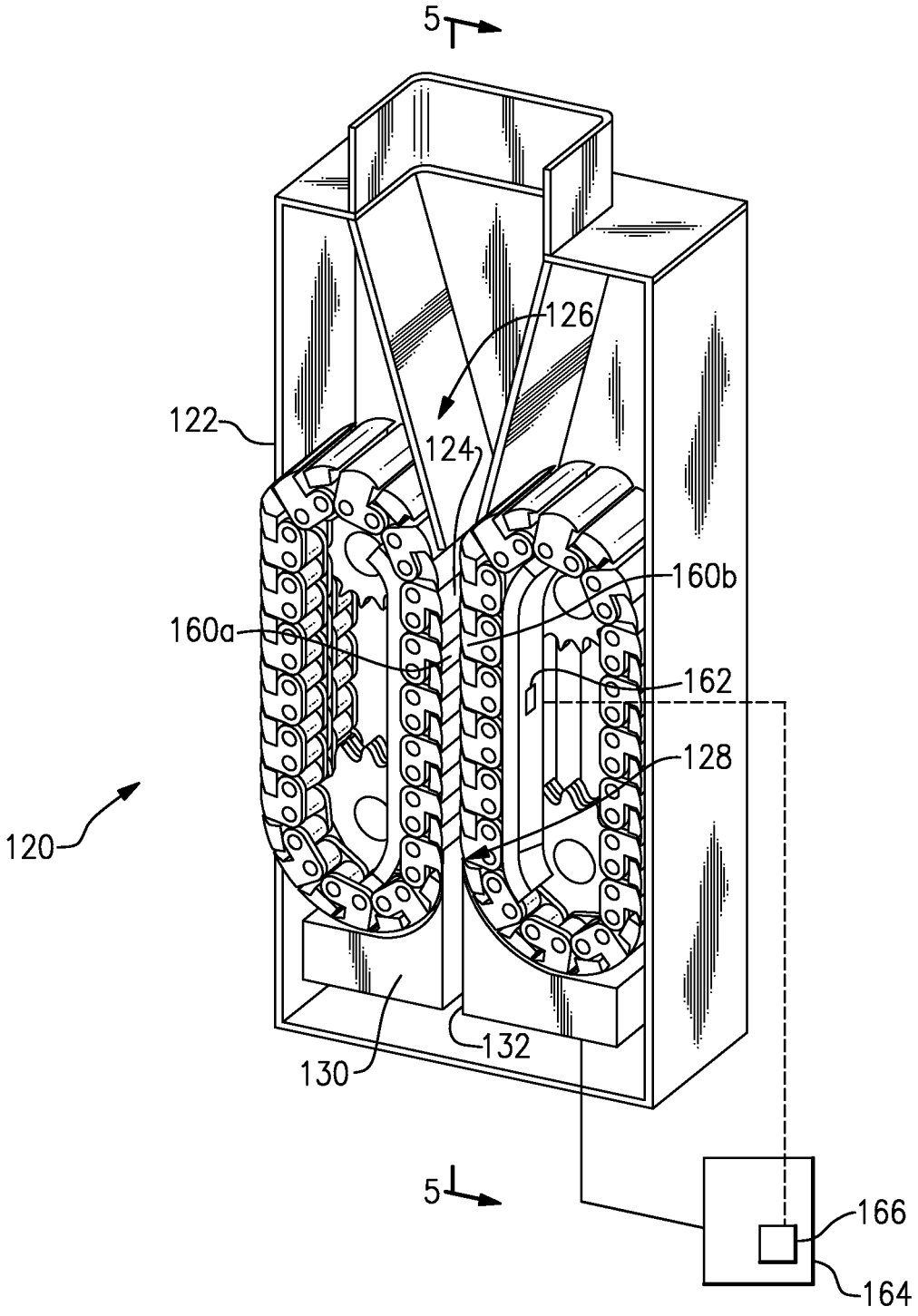
FIG. 4 illustrates another example pressure vessel that includes a moving wall pump.
Figure 5:
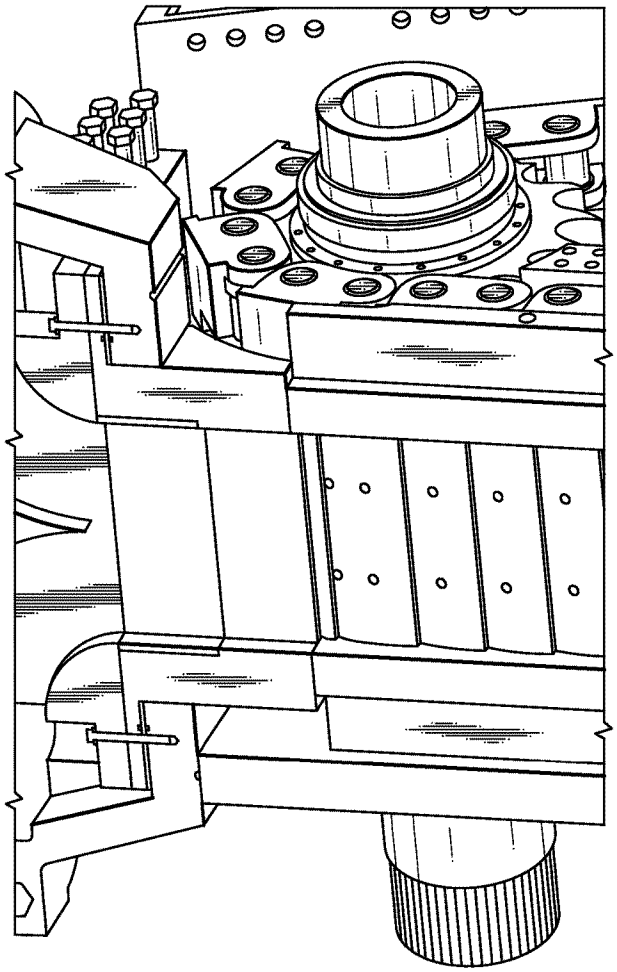
FIG. 5 illustrates a sectioned view of the pressure vessel of FIG. 4.

FIG. 4, and a sectioned view in FIG. 5, illustrate portions of another example pressure vessel 120 that is similar to the example of FIG. 1 but discloses a specific type of pump, a moving-wall pump. In this disclosure, like reference numerals designate like elements where appropriate and reference numerals with the addition of one-hundred or multiples thereof designate modified elements that are understood to incorporate the same features and benefits of the corresponding original elements. In this case, the moving-wall pump 122 includes two moving walls 160*a* and 160*b* that, at least in part, define sidewalls of the passage 124 through the pump 122. The moving walls 160*a* and 160*b* are operative to move along the passage 124, substantially parallel to the centerline 136 of the passage 124. The remaining walls that form the passage 124 are fixed walls, although FIG. 4 does not illustrate a fixed front wall to enable observation into the pressure vessel 120. It is to be understood that the term "moving wall" or variations thereof as utilized in this disclosure may refer to a belt to transport dry particulate material and generate work from the interaction between the moving walls 160*a* and 160*b* and the material therebetween.

The pressure vessel 120 may include a sensor 162 that is capable of detecting a gas pressure within the pump 122. Additional sensors 162 may also be used. In this example, the sensor 162 is located behind the belt tracks that form the moving walls 160*a* and 160*b*. However, in other examples, it is to be understood that the sensor 162 may be located in other areas of the pump 122. The sensor 162 is operatively connected to an actuator 164, which is operatively connected with the duct 130.

The actuator 164 includes a controller 166, which in this case is integrated into the actuator 164. Alternatively, the controller 166 may be provided as a separate component from the actuator 164. The actuator 164 is operatively connected to at least one wall of the duct 130 to adjust the position of the wall as described above. As an example, the actuator 164 may be a hydraulic, pneumatic or other type of actuator suitable for moving at least one wall of the duct 130.

In operation, the controller 166 operates the moving walls 160*a* and 160*b* to transport the particulate material through the passage 124 toward the duct 130. The sensor 162 detects a gas pressure within the pump 122. The pressure exerted onto the particulate material within the pump 122 upstream of the inlet of the duct 130 consolidates the particulate material within the passage 132 of the duct 130 to form a plug as a dynamic seal, as described above. The plug functions to limit backflow of gas through the passage 132 and passage 124.

The sensor 162 detects the gas pressure such that if gas permeates through the plug into the pump 122, the detected gas pressure changes. In response to a change in pressure, the controller 166 may command the actuator 164 to move one or more of the walls of the duct 130 to adjust the pressure on the particulate material within the passage 132. That is, if the amount of gas that leaks through the plug increases, the controller 166 may instruct the actuator 164 to change one or more dimensions of the passage 132 to increase the pressure on the particulate material in the duct 130. As an example, increasing the length 34 of the passage 132 increases the pressure on the plug to provide a greater sealing effect. Similarly, reducing the width 38 or depth 40 of the passage 132 increases the pressure on the particulate material and facilitates increasing the sealing effect. Conversely, to reduce pressure on the particulate material in the duct 130, the controller 166 causes a reduction in the length dimension 34 or an increase in the dimensions 38 and 40. Thus, the controller 166 may control the dimensions 34, 38, and 40 and operation of the pump 122 to maintain a desired degree of consolidation of the particulate material within the passage 132 of the duct 130 for the purpose of controlling the degree of sealing.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A pressure vessel comprising:

a pump including a passage extending between an inlet and an outlet; and a duct at the pump outlet, the duct including a duct passage defining a length, a uniform width along the length and a uniform depth along the length, at least one of which is adjustable, wherein the duct includes at least one wall that is movable to influence pressure that the wall exerts on a dynamic seal responsive to a detected gas pressure in the pump.

2. The pressure vessel as recited in claim 1, wherein the uniform width and the uniform depth are substantially perpendicular to a centerline of the passage of the pump.

3. The pressure vessel as recited in claim 1, wherein the length is substantially parallel to a centerline of the passage of the pump.

4. The pressure vessel as recited in claim 1, further comprising an actuator operatively connected with at least one wall of the duct to adjust at least one of the length, the uniform width along the length and the uniform depth along the length.

5. The pressure vessel as recited in claim 1, wherein the duct includes at least one wall having a first wall section and an adjacent second wall section that is movable relative to the first wall section.

6. The pressure vessel as recited in claim 1, wherein the length is adjustable.

7. The pressure vessel as recited in claim 1, wherein at least one of the uniform width along the length and the uniform depth along the length is adjustable.

8. The pressure vessel as recited in claim 1, wherein the passage of the pump has a generally constant cross-sectional area between the inlet and the outlet and is defined on two sides by respective belts that are moveable along the passage.

9. The pressure vessel as recited in claim 1, wherein the passage of the pump and the duct passage both have rectangular cross-sections.

10. A method of sealing a pressure vessel, comprising:

pumping a particulate material through a passage of a pump having a low pressure inlet, a high pressure outlet and a generally constant cross-sectional area, the pumping including moving two side belts in a direction along the passage;

consolidating a portion of the particulate material within a duct at the high pressure outlet of the passage to form a plug of consolidated particulate material as a seal that limits backflow of gas through the passage, including adjusting a dimension of the duct to control the seal; and adjusting the dimension to influence pressure that the duct exerts on the plug as a function of a detected gas pressure in the pump.

11. The method as recited in claim 10, wherein the dimension is substantially parallel to a centerline of the passage.

12. The method as recited in claim 10, wherein the dimension is substantially perpendicular to a centerline of the passage.

13. The method as recited in claim 10, wherein the passage of the pump has a rectangular cross-section.

14. A pressure vessel comprising:

a particulate pump including a passage having a generally constant cross-sectional area between a pump inlet and a pump outlet, the passage being defined on two sides by respective belts that are movable along the passage;

a duct downstream of the particulate pump, the duct including a duct inlet connected to the pump inlet at a first fluid pressure, a duct outlet at a second fluid pressure higher than the first fluid pressure, and a duct passage extending form the duct inlet to the duct outlet, the duct passage defining a length, a uniform width along the length and a uniform depth along the length, at least one of which is adjustable; and a dynamic seal consisting essentially of consolidated particulate, wherein the dynamic seal is between the duct inlet and the duct outlet; and a sensor within the particulate pump and a controller in communication with the sensor and operable to adjust at least one of the length, the uniform width along the length and the uniform depth along the length to influence pressure that the duct passage exerts on the dynamic seal responsive to a detected gas pressure in the particulate pump from the sensor.

15. The pressure vessel as recited in claim 14 wherein a dimension of the constant cross-section is selectively controlled.

16. The pressure vessel as recited in claim 1, further comprising a sensor within the pump and a controller in communication with the sensor and operable to adjust at least one of the length, the uniform width along the length and the uniform depth along the length to influence pressure that the duct passage exerts on the dynamic seal responsive to a detected gas pressure in the pump from the sensor.

17. The pressure vessel as recited in claim 14, wherein the passage of the particulate pump and the duct passage both have rectangular cross-sections.

18. 1 A pressure vessel comprising:

a pump including a passage extending between an inlet and an outlet; and a duct at the pump outlet, the duct including a duct passage defining a length, a uniform width along the length and a uniform depth along the length, at least one of which is adjustable, wherein at least one of the length, the uniform width along the length and the uniform depth along the length is dynamically adjustable to influence pressure that the duct passage exerts on a dynamic seal responsive to a detected gas pressure in the pump.

19. A method of sealing a pressure vessel, comprising:

pumping a particulate material through a passage of a pump having a low pressure inlet, a high pressure outlet and a generally constant cross-sectional area, the pumping including moving two side belts in a direction along the passage;

consolidating a portion of the particulate material within a duct at the high pressure outlet of the passage to form a plug of consolidated particulate material as a seal that limits backflow of gas through the passage, including adjusting a dimension of the duct to control the seal; and dynamically adjusting at least one of a length, a uniform width along the length and a uniform depth along the length of a duct passage in the duct to influence pressure that the duct passage exerts on the plug responsive to a detected gas pressure in the pump.

* * * * *